US005820255A

United States Patent [19]

Carrington et al.

[11] Patent Number: 5,820,255

[45] Date of Patent: Oct. 13, 1998

[54] LIGHTING-FIXTURE SUPPORT POLE

[75] Inventors: James S. Carrington; Donald Wandler, both of Racine, Wis.

[73] Assignee: Ruud Lighting, Inc., Racine, Wis.

[21] Appl. No.: 801,902

[22] Filed: Feb. 14, 1997

[51] Int. Cl.[6] ..... F21S 1/10; F21S 3/10; F21S 17/00

[52] U.S. Cl. ..... 362/431; 362/411; 174/45 R; 174/58; 174/65 R; 52/40

[58] Field of Search ..... 362/431, 410, 362/411; 174/45 R, 58, 65 R, 66, 67; 52/40, 292, 726.4

[56] References Cited

U.S. PATENT DOCUMENTS

| | | | |
|---|---|---|---|
| 3,142,721 | 7/1964 | Long | 174/65 R |
| 3,185,757 | 5/1965 | Phillips . | |
| 3,215,831 | 11/1965 | Gladsden et al. | 362/431 |
| 3,242,252 | 3/1966 | Bergenstein . | |
| 3,369,331 | 2/1968 | Deskey et al. | 52/38 |
| 3,521,047 | 7/1970 | Smith | 362/222 |
| 3,801,813 | 4/1974 | Kiehn | 362/391 |
| 3,862,411 | 1/1975 | Persson | 362/431 |
| 4,156,272 | 5/1979 | Wandler | 362/432 |
| 4,733,015 | 3/1988 | Barnes | 174/65 R |
| 4,794,207 | 12/1988 | Norberg et al. | 174/48 |
| 4,851,980 | 7/1989 | McWilliams et al. | 362/403 |
| 4,878,160 | 10/1989 | Reneau et al. | 362/269 |
| 4,914,258 | 4/1990 | Jackson | 174/45 R |
| 5,155,300 | 10/1992 | Brandner | 174/65 R |
| 5,296,647 | 3/1994 | Banker | 174/58 |
| 5,335,160 | 8/1994 | Savoca | 362/431 |
| 5,426,577 | 6/1995 | Gordin et al. | 362/431 |
| 5,483,019 | 1/1996 | Tourigny | 174/45 R |
| 5,524,411 | 6/1996 | Crossman | 52/736.1 |
| 5,527,993 | 6/1996 | Shotey et al. | 174/67 |
| 5,550,708 | 8/1996 | Siems | 361/642 |
| 5,581,958 | 12/1996 | Cote | 52/40 |

FOREIGN PATENT DOCUMENTS

| | | | |
|---|---|---|---|
| 2220747 | 4/1974 | France | 362/431 |

*Primary Examiner*—Ira S. Lazarus
*Assistant Examiner*—Ljiljana V. Ciric
*Attorney, Agent, or Firm*—Jansson, Shupe, Bridge & Munger, Ltd.

[57] ABSTRACT

A lighting-fixture support pole includes an interior cavity and a hand-hole opening having a length and a width. The improvement comprises a mounting plate having an interior surface and a sealing member compressed between such surface and the pole. The sealing member has an aperture therethrough with dimensions about equal to the length and width, respectively, of the hand-hole opening. A termination box extends from the mounting plate into the cavity and a receptacle is on the exterior surface of the mounting plate. The improved support pole permits a customer to opt for a blank plate or for a plate-mounted receptacle to close the opening. No opening other than the hand-hole opening need be provided in the pole.

13 Claims, 5 Drawing Sheets

LIGHTING-FIXTURE SUPPORT POLE

FIELD OF THE INVENTION

This invention is related generally to illumination and, more particularly, to pole-type supports for lighting fixtures.

BACKGROUND OF THE INVENTION

Outdoor flood and "wide-area" lighting fixtures and support poles are used to illuminate, e.g., parking lots, walkways and the like. A major manufacturer of such fixtures and poles is Ruud Lighting, Inc., Racine, Wis., the assignee of the invention.

Such fixtures are often supported above the illuminated surface by relatively long poles. A common type of fixture-supporting pole is hollow, rectangular (e.g., square) in cross-section and includes a base support welded or otherwise affixed to the pole bottom. The base support has bolt holes by which the base is attached to bolts set in concrete.

An underground electrical feed line is brought to the pole and is inserted through an aperture in the base support. Such feed line is extended upwardly through the pole to connect to fixture wiring.

To facilitate handling the feed line and the fixture wiring and the connection thereof, it is common practice to fabricate the pole with an above-ground opening of a size sufficient to permit the electrician to reach into the pole cavity. If the pole is painted, paint is applied to the pole and to the edges of such opening after the opening is cut.

In industry parlance, such opening is referred to as a "hand-hole" or "hand-hole opening." After installation of the pole and fixture is complete, the opening is closed with a blank closure plate.

But some purchasers of outdoor lighting poles wish to have such poles (or some of those ordered) rigged to include an electrical receptacle. When a pole receptacle is used, it is considered desirable to have the receptacle apparatus within the pole, i.e., with the receptacle surface more or less flush with the pole surface.

This has required that a separate pole opening (and related receptacle mounting) be used. Typically, such separate pole opening has been formed at a position (e.g., two feet, about 0.61 meters, from the base of the pole) spaced from the normal hand-hole opening position (e.g., one foot, about 0.31 meters, from the base of the pole), the latter used for making the connections essential for the lighting fixture.

Thus, poles requiring electrical receptacles may have to be custom ordered—only a small percentage of purchasers, on the order of 10%, ask for such receptacles. And custom ordering will typically delay shipment.

And these are not the only disadvantages attending a fixture support pole with a separate receptacle opening. The use of separate openings for normal pole access and receptacle mounting, respectively, produces a pole which is visually inferior in that it has more external lines and features than would otherwise be the case. And, with multiple openings, there is more opportunity for vandalism and for moisture ingress and corrosion.

The known prior art does not address these needs.

For example, U.S. Pat. No. 3,521,047 (Smith) shows a fluorescent yard light, the post assembly of which uses corner moldings to hold scalloped or corrugated intermediate portions in place. One such portion has a receptacle mounted in it and the post assembly appears to be of double wall construction.

U.S. Pat. No. 3,215,831 (Gladsden et al.) discloses a combination outdoor lamp-post and utility outlet. The outlet including its associated housing are exterior to and clamped around a cylindrical pole. Other patents, e.g., U.S. Pat. Nos. 3,801,813 (Kiehn) and 4,878,160 (Reneau et al.) disclose pole access doors.

A new lighting fixture support pole which overcomes disadvantages of known poles would be an important advance in the art.

OBJECTS OF THE INVENTION

It is an object of this invention to provide a lighting fixture support pole overcoming some of the problems and shortcomings of the prior art.

Another object of this invention is to provide a lighting fixture support pole having a hand-hole opening and a receptacle configured for mounting in such opening.

Another object of this invention is to provide a receptacle-equipped lighting fixture support pole which is aesthetically attractive.

Another object of this invention is to provide a lighting fixture support pole having a receptacle and only a single hand-hole opening, i.e., an opening of a size to permit manual wiring operations.

Another object of this invention is to provide a lighting fixture support pole which obviates custom pole fabrication for receptacle mounting.

Still another object of this invention is to provide a lighting fixture support pole which helps avoid delays in shipping poles having receptacles.

Another object of this invention is to provide a lighting fixture support pole which is resistant to vandalism.

Another object of this invention is to provide a lighting fixture support pole configured to help prevent moisture ingress. How these and other objects are accomplished will become apparent from the following descriptions and from the drawings.

SUMMARY OF THE INVENTION

The invention involves an improvement in a lighting-fixture support pole of the type having an interior cavity and a generally rectangular hand-hole opening having a length and a width. The improvement comprises a mounting plate having an interior surface and a gasket-like sealing member compressed between such interior surface and the exterior surface of the pole. Most preferably, such pole exterior surface is substantially planar.

The sealing member has an aperture therethrough with dimensions about equal to the length and width, respectively, of the corresponding dimensions of the opening. A termination box extends from the mounting plate into the cavity and a receptacle is on the exterior surface of the mounting plate.

The sealing member is around the box and, preferably, the box and the sealing member are spaced slightly from one another for ease of assembly. There is also a second, gasket-like sealing member compressed between the receptacle and the exterior surface.

In another aspect of the invention, the mounting plate, the box and the receptacle are secured to one another by a first pair of fasteners defining an axis. The mounting plate has a second pair of fasteners in registry with the axis and each fastener of the second pair has an elongate attachment clip with a fastener clearance notch. Each such fastener of the second pair is thereby also in registry with the axis. In a specific embodiment, the mounting plate has side edges which are substantially vertical when the plate is mounted on the pole and the axis is parallel to such side edges.

Some types of poles, e.g., a hollow aluminum pole which is 5 inches square (about 32 sq. cm.) in cross-section, have a reinforcing collar around the hand-hole opening and extending into the pole cavity. When the mounting plate and its receptacle are affixed to the pole, the box extends into the collar.

In another aspect of the invention, the collar is bounded by a rim within the cavity, i.e., well inward from the pole outer surface. The mounting plate has a pair of fasteners, each having an attachment clip on it. Each attachment clip has a leg engaging the rim and when the fasteners are tightened, the clips are drawn toward the mounting plate and tightly against the rim for secure receptacle mounting.

In yet another aspect of the invention, the hand-hole opening has a corrosion-protected (e.g., painted) edge defining an area sufficient for manual wiring operations involving, perhaps, reaching through the opening into the pole cavity. Certainly such area should not be less than 4 square inches (about 26 square cm.) and, most preferably, such area is rectangular and on the order of 8 to 12 square inches (about 52 to 77 square cm.) with 2 inches (about 5.1 cm.) being the shorter dimension. The hand-hole opening is the only opening in the pole having an area sufficient for such purpose. Most preferably, such opening is the only opening in the pole (other than, perhaps, openings having fasteners therethrough) having an area in excess of 4 square inches (about 26 square cm.). Currently, the smallest opening sufficient for manual wiring operations is 2 inches by 4 inches (about 5.1 cm. by about 10.2 cm.).

The pole is used in combination with (a) a lighting fixture supported by the pole, and (b) first and second electrical feed lines extending along the cavity. The first feed line bypasses the box and is connected to the lighting fixture and the second feed line is connected through the box to the receptacle. Electrical power to each feed line is controlled by a separate switch so that the fixture may be turned on and off without disconnecting power to the receptacle.

Other details of the invention are set forth in the following detailed description and in the drawings.

DETAILED DESCRIPTION OF THE PREFERRED EMBODIMENTS

Figure 1:
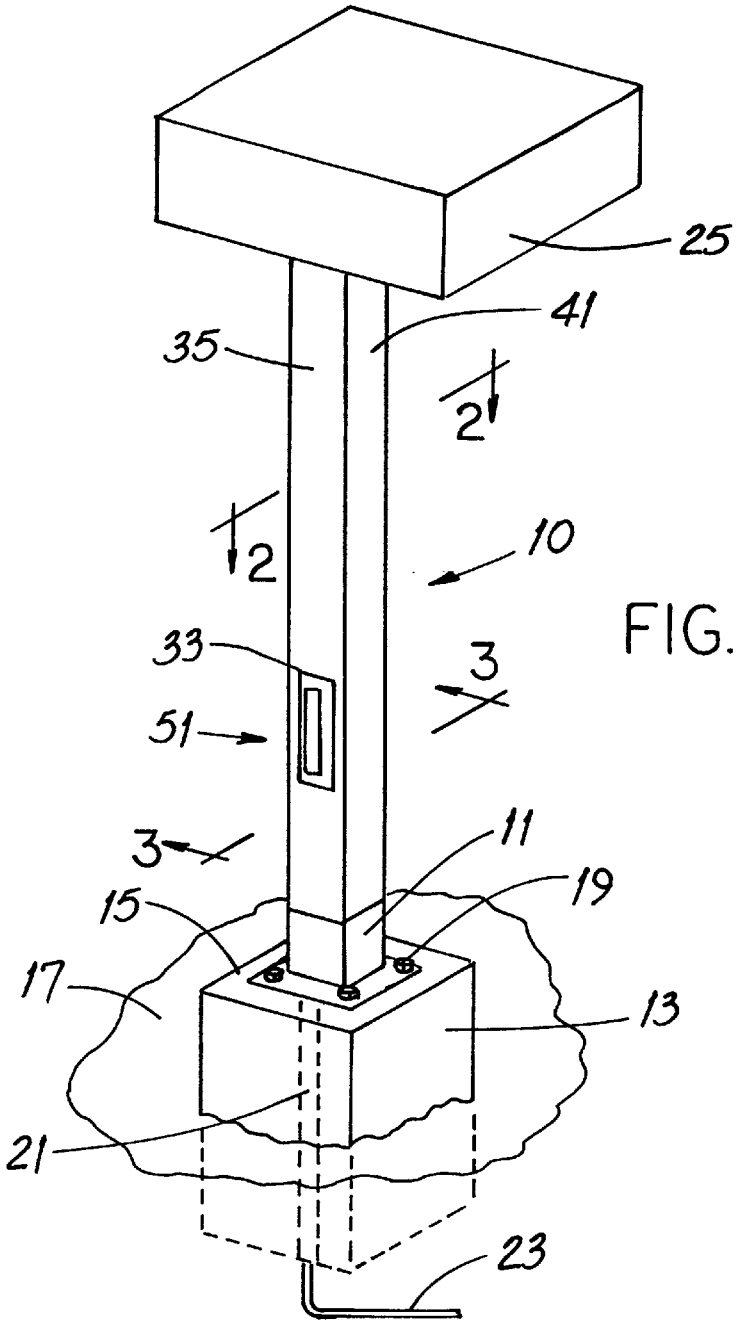
FIG. 1 is a perspective view of the new lighting-fixture support pole shown in conjunction with a lighting fixture and a pedestal. Surfaces of parts are shown in dashed outline.
Figure 2:
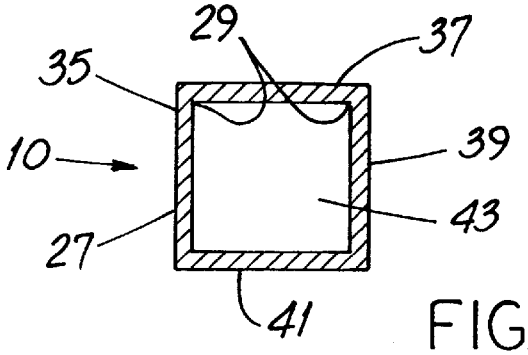
FIG. 2 is a section plan view of the pole of FIG. 1 taken along the viewing plane 2—2 thereof.

Before describing details of the new lighting-fixture support pole 10, it will be helpful to have an understanding of some aspects of a typical pole and fixture installation. FIG. 1 shows a lighting-fixture support pole 10 rigidly attached to a base support 11 by welding, bolts or the like. The base support 11 rests upon a concrete pedestal 13, the horizontal upper surface 15 of which is at or above ground level 17. The base support 11 and the pedestal 13 are attached to one another by upwardly-extending bolts 19 permanently set into the pedestal 13.

The concrete pedestal 13 is poured around a central conduit 21 through which an underground electrical feed line 23 is extended, using a splice, to the fixture 25. A common practice is to attach a length of feed line to the fixture 25 before mounting the fixture 25 and pole 10 and then "thread" such feed line downwardly through the pole 10.

Referring next to FIGS. 2, 3, 4, and 5, the cross-sectional shape of a highly preferred pole 10 is that of a four-sided parallelogram 27, the angles 29 of which are all right angles. However, it will be apparent from this specification that a pole 10 having a flat wall to accommodate the hand-hole opening 31 and mounting plate 33 will function well, irrespective of the pole cross-sectional shape.

Figure 4:
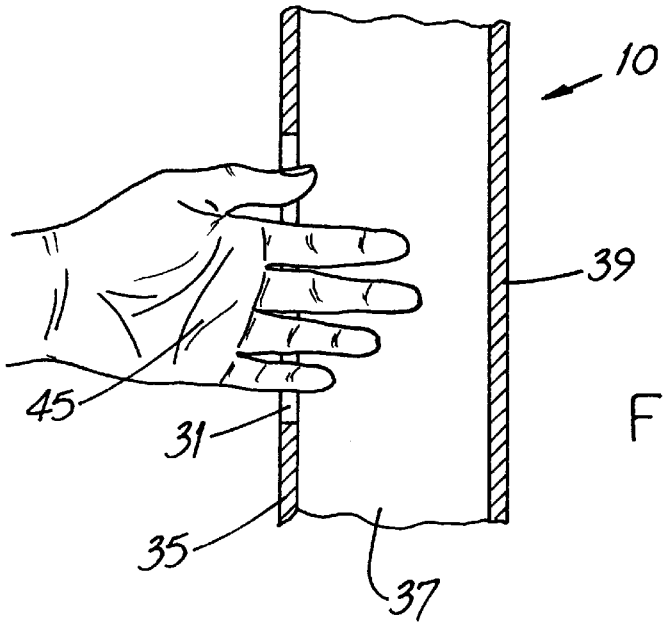
FIG. 4 is a section elevation view of the pole of FIG. 1 shown in conjunction with a human hand. Parts are broken away.

The depicted pole 10 has four walls 35, 37, 39, 41 which define a pole interior cavity 43. One (and only one) wall, e.g., wall 35, has a hand-hole opening 31 formed therein and having a length L1 and a width W1. Further, the opening 31 is the only opening in any wall 35, 37, 39, 41 which is of a size sufficient to be used for manual wiring operations. To state it in other words, the walls 37, 39, 41 are free of any opening of a size adequate for manual wiring operations although any one or more of such walls 35, 37, 39, 41 may have fastener holes or the like formed therein. (As a practical matter, for the opening 31 to be of a size sufficient to be used for manual wiring operations, e.g., feed line pulling and the like, such opening 31 must permit the insertion of an adult human hand 45 as shown in FIG. 4.)

An approximate minimum opening area is not less than 4 square inches (about 26 square cm.) and a highly preferred opening is about 8 to 12 square inches (about 52 to 77 square cm.) in area and has a horizontal width W1 of about 2 inches (about 5.1 cm.). Current U.S. code requires an opening of at least 2 inches by 4 inches, i.e., about 5.1 cm. by about 10.2 cm. Typically, the pole 10 is painted after the opening 31 is formed and shown in FIG. 6, the edges 47 of such opening 31 have paint 49 applied thereto for rust and corrosion protection.

Referring particularly to FIGS. 1, 3, 7 and 8, a receptacle assembly 51 has a rigid mounting plate 33 having an interior surface 53, an exterior surface 55 and a gasket-like resilient sealing member 57 compressed between such interior surface 53 and the exterior surface 59 of the pole wall 35.

The sealing member 57 has an aperture 61 with dimensions L1' and W1' which are about equal to the length L1 and width W1, respectively, of the opening 31. A termination box 63 extends from the mounting plate 33 into the cavity 43 and forms a small enclosure in which the feed line 23 and the receptacle terminals are connected to one another. A receptacle 65 is on the exterior surface 55 of the mounting plate 33 and a top-hinged protective cover 67 protects such receptacle 65.

The sealing member 57 is around the box 63 and, preferably, the box 63 and the sealing member 57 have a space 69 therebetween. There is also a second, gasket-like resilient sealing member 71 compressed between the receptacle platform 73 and the exterior surface 55 of the mounting plate 33.

Figure 3:
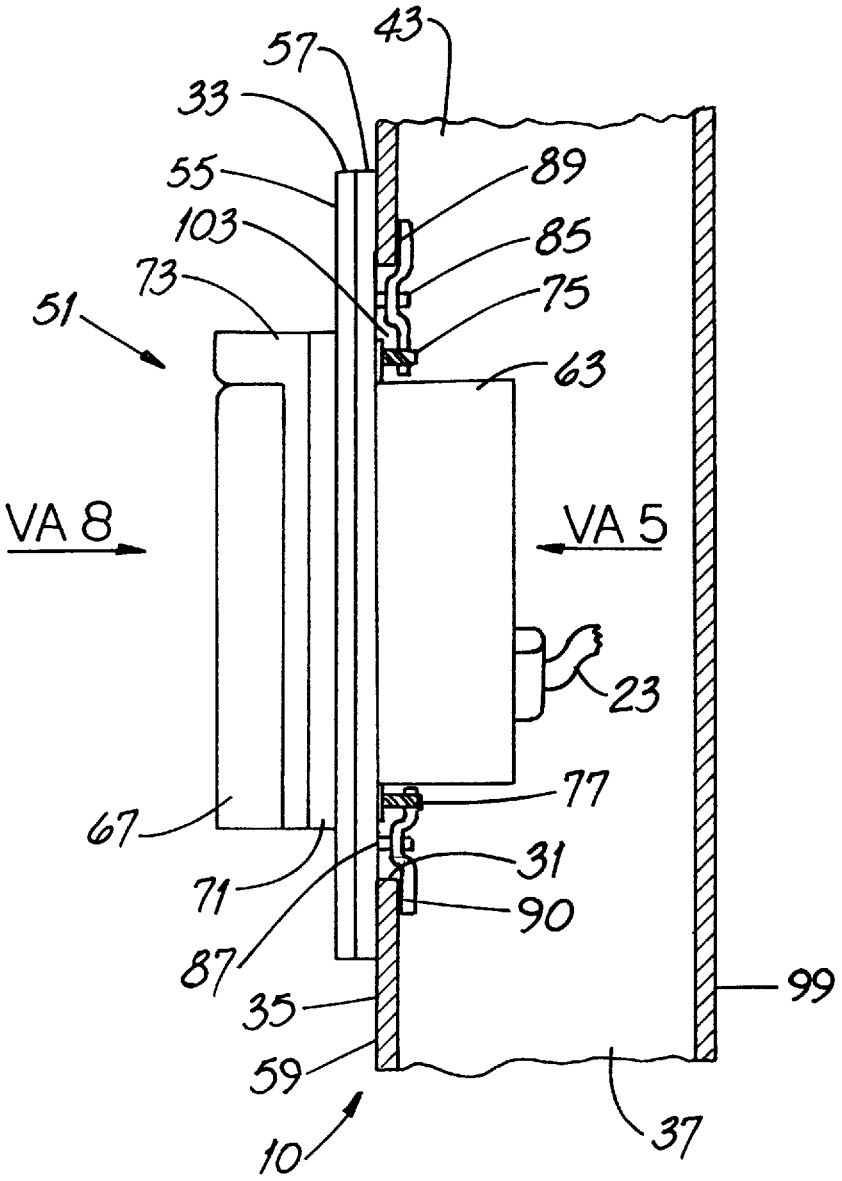
FIG. 3 is a sectional elevation view of the pole of FIG. 1 taken along the viewing plane 3—3 thereof. The pole is shown in section and the receptacle assembly is shown in full representation. Parts are broken away.
Figure 7:
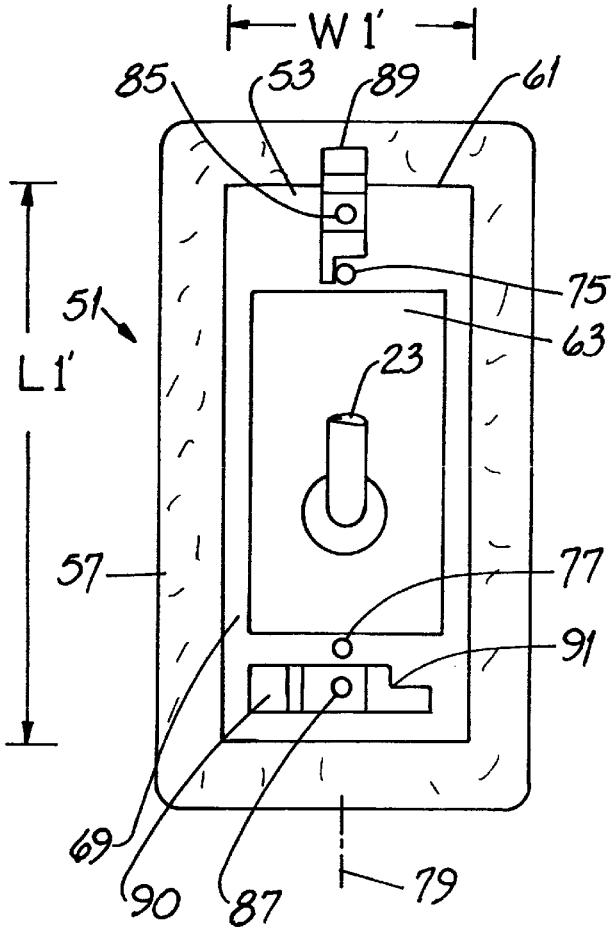
FIG. 7 is a rear side elevation view of the receptacle assembly shown in FIG. 3. Parts are broken away.
Figure 5:
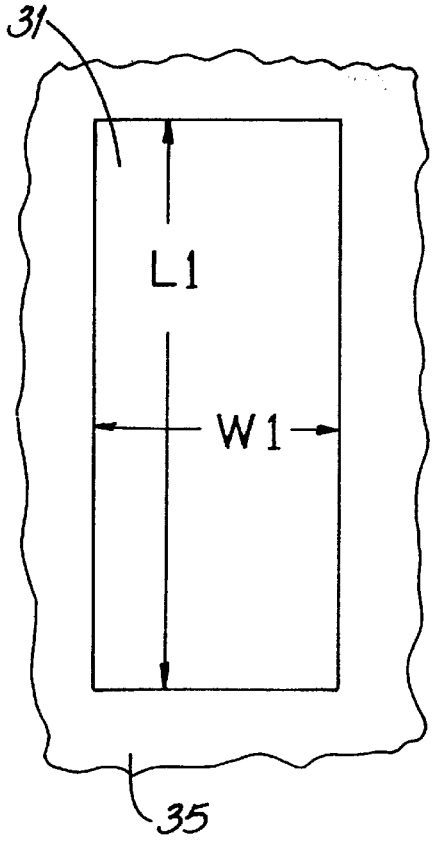
FIG. 5 is an elevation view of the hand-hole opening in the pole. Such view is taken along the viewing axis VA5 of FIG. 1.
Figure 8:
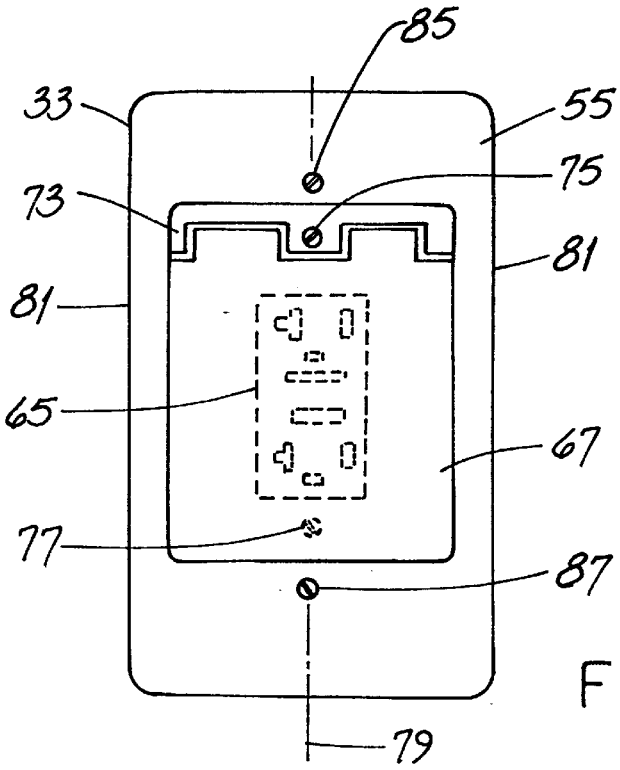
FIG. 8 is a front elevation view of the receptacle assembly shown in FIG. 3. Such view is taken along the viewing axis VA8 of FIG. 3. The receptacle is shown in phantom, i.e., dashed outline.

Referring particularly to FIGS. 3, 7 and 8, the mounting plate 33, the box 63 and the receptacle platform 73 are secured to one another by a first pair of fasteners 75, 77 defining an axis 79. In a specific embodiment, the mounting plate 33 has side edges 81 which are substantially vertical when the plate 33 is mounted on the pole 10 and the axis 79 is parallel to such side edges 81.

The mounting plate 33 has a second pair of fasteners 85, 87 in registry with the axis 79 and each fastener of the second pair 85, 87 has an elongate attachment clip 89, 90, respectively, each with a fastener clearance notch 91. FIG. 3 shows both attachment clips 89, 90 in their assembly-retaining positions overlapping and securing the assembly 51 to the pole wall 35. FIG. 7 shows one attachment clip 89 in the assembly-retaining position and shows the other attachment clip 90 rotated 90° to the position used when inserting the box 63 into the opening 31 during assembly mounting. Each such fastener 85, 87 of the second pair is also in registry with the axis 79.

Figure 10:
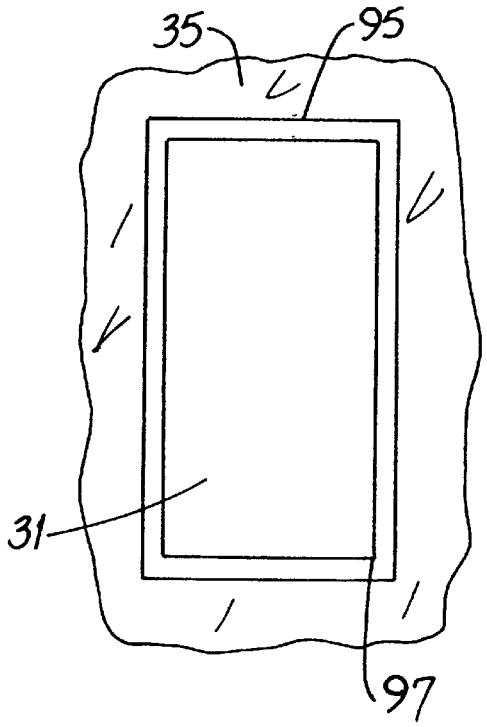
FIG. 10 is an elevation view of the hand-hole opening of FIG. 9 taken along the viewing axis VA10 thereof. Parts are broken away.
Figure 9:
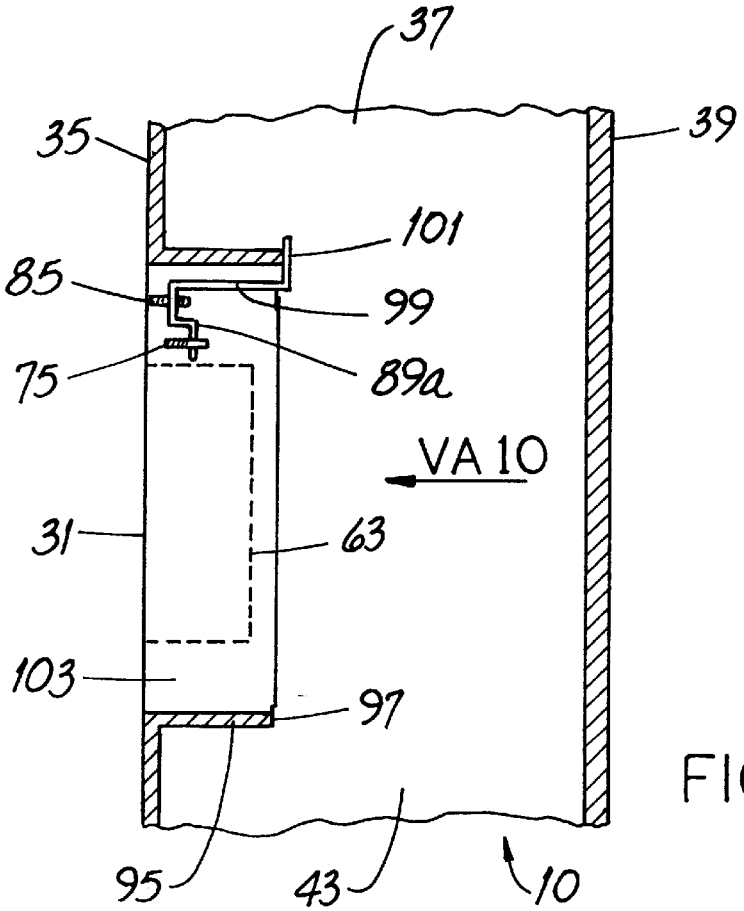
FIG. 9 is a sectional elevation view, generally like FIG. 3, of another embodiment of the pole and its hand-hole opening. Surfaces of parts are shown in dashed outline and other parts are broken away.

Referring next to FIGS. 9 and 10, some types of poles 10, e.g., a hollow aluminum pole which is 5 inches (about 12.7 square cm.) in cross-section, have a reinforcing collar 95 around the hand-hole opening 31 and extending into the pole cavity 43. When the mounting plate 33 and its receptacle 65 are affixed to the pole 10, the box 63 extends into the collar 95.

Figure 6:
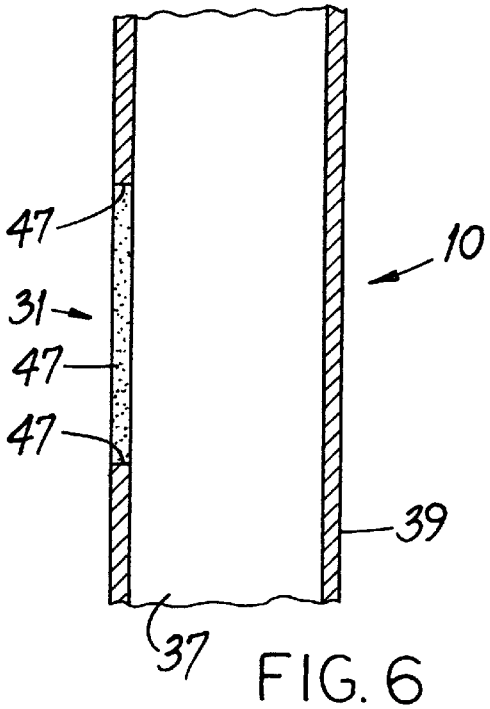
FIG. 6 is a section elevation view of the pole of FIG. 1 showing the painted opening edge. Parts are broken away.

The collar 95 is bounded by a rim 97 within the cavity 43, i.e., well inward from the wall 35. The mounting plate 33 has a pair of fasteners 85, 87, each having an attachment clip 89*a* on it. Each attachment clip 89*a* has an elongate leg 99 with a lip 101 engaging the rim 97 and when the fasteners 85, 87 are tightened, the clips 89*a* are drawn toward the mounting plate 33 and tightly against the rim 97 for secure assembly mounting. Considering FIGS. 3, 6 and 9, irrespective of whether the opening 31 has an edge 47 as shown in FIG. 6 or a collar 95 as shown in FIG. 9, the edge 47 and the box 63 or the collar 95 and the box 63 (as the case may be) have a space 103 therebetween which extends around the box 63.

Figure 11:
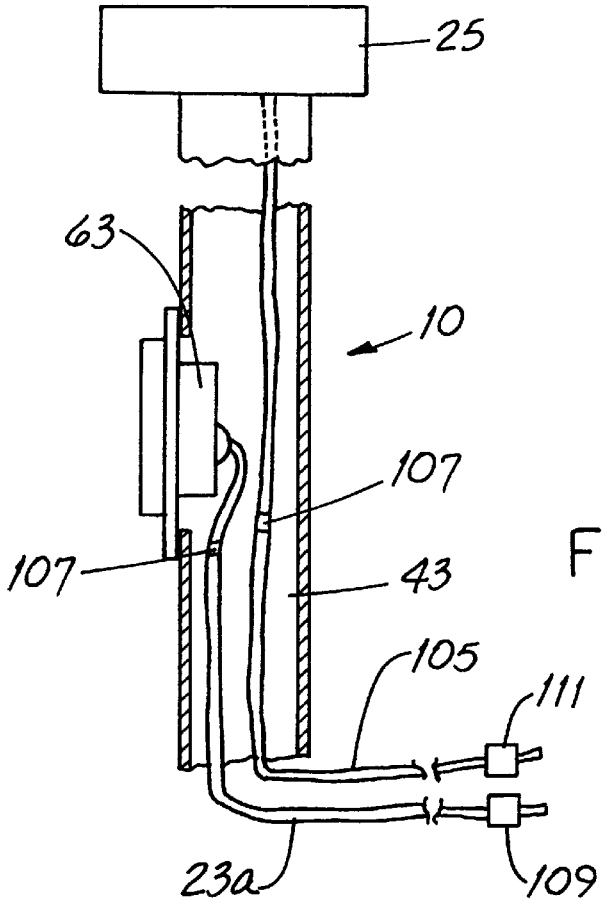
FIG. 11 is a partial sectional elevation view showing one wiring arrangement that may be used with the new pole. Some parts are shown in full representation and other parts are broken away.

Referring next to FIGS. 1, 8 and 11, the pole 10 is used in combination with a lighting fixture 25 supported by the pole 10, and first and second electrical feed lines 23*a* and 105, respectively, which extend along the cavity 43. The second feed line 105 bypasses the box 63 and is connected to the lighting fixture 25 and the first feed line 23*a* is connected through the box 63 to the receptacle 65. Connections are made using splices 107. Electrical power to each feed line 23*a*, 105 is controlled by a separate switch 109, 111, respectively, so that the fixture 25 may be turned on and off without disconnecting power to the receptacle 65.

While the principles of this invention have been described in connection with specific embodiments, it should be understood clearly that these descriptions are made only by way of example and are not intended to limit the scope of the invention.

What is claimed:

1. In an elongate, upright, earth-mounted lighting-fixture support pole including an interior cavity and a hand-hole opening having a length and a width, the improvement comprising:

a mounting plate around the opening and having an interior surface and an exterior surface;

a sealing member compressed between the interior surface and the pole and having an aperture therethrough with dimensions about equal to the length and width, respectively;

a termination box extending from the mounting plate through the hand-hole opening into the cavity; and a receptacle assembly fixed with respect to the exterior surface;

and wherein:

the mounting plate, the termination box and the receptacle assembly are secured to the pole free of welds.

2. The pole of claim 1 wherein:

the pole has an exterior surface which is substantially planar; and the sealing member is compressed between the exterior surface of the pole and the interior surface of the mounting plate.

3. The pole of claim 2 wherein:

the sealing member is around the box; and the box and the sealing member are spaced from one another.

4. The pole of claim 3 including a second sealing member compressed between the receptacle assembly and the exterior surface of the mounting plate.

5. The pole of claim 1 wherein:

the mounting plate, the box and the receptacle are secured to one another by a first pair of fasteners defining an axis;

the mounting plate has a second pair of fasteners in registry with the axis; and each fastener of the second pair of fasteners has an elongate attachment clip with a fastener clearance notch, thereby permitting each fastener of the second pair to be aligned with the axis.

6. The pole of claim 5 wherein:

the mounting plate has substantially vertical side edges; and the axis is parallel to the side edges.

7. The pole of claim 1 including a reinforcing collar around the opening and extending into the cavity and the box extends into the collar.

8. The pole of claim 7 wherein:

the collar has a rim within the cavity;

the mounting plate has a pair of fasteners, each fastener having an attachment clip thereon; and each attachment clip has a leg engaging the rim.

9. The pole of claim 1 wherein:

the hand-hole opening is the only opening in the pole defining an area of at least four square inches.

10. The pole of claim 1 in combination with (a) a lighting fixture supported above the earth by the pole, and (b) first and second electrical feed lines extending from a buried location upwardly along the cavity and wherein:

the first feed line bypasses the box and is connected to the lighting fixture; and the second feed line is connected to the receptacle assembly through the box.

11. The combination of claim 10 wherein electrical power to each feed line is controlled by a separate switch.

12. In a lighting-fixture support pole including an interior cavity and a hand-hole opening having a length and a width, the improvement comprising:

a mounting plate around the opening and having an interior surface and an exterior surface;

a sealing member compressed between the interior surface and the pole and having an aperture therethrough with dimensions about equal to the length and width, respectively;

a termination box extending from the mounting plate through the hand-hole opening into the cavity; and a receptacle assembly on the exterior surface;

and wherein:

the mounting plate, the box and the receptacle assembly are secured to one another by a first pair of fasteners defining an axis;

the mounting plate has a second pair of fasteners in registry with the axis; and each fastener of the second pair of fasteners has an elongate attachment clip with a fastener clearance notch, thereby permitting each fastener of the second pair to be aligned with the axis.

13. The pole of claim 12 wherein:

the mounting plate has substantially vertical side edges; and the axis is parallel to the side edges.

* * * * *